US006978619B2

(12) United States Patent
Blomeyer

(10) Patent No.: US 6,978,619 B2
(45) Date of Patent: Dec. 27, 2005

(54) PREMIXED BURNER WITH PROFILED AIR MASS STREAM, GAS TURBINE AND PROCESS FOR BURNING FUEL IN AIR

(75) Inventor: Malte Blomeyer, Mülheim (DE)

(73) Assignee: Siemens Aktiengesellschaft, Munich (DE)

( * ) Notice: Subject to any disclaimer, the term of this patent is extended or adjusted under 35 U.S.C. 154(b) by 172 days.

(21) Appl. No.: 10/667,291

(22) Filed: Sep. 19, 2003

(65) Prior Publication Data

US 2004/0055270 A1 Mar. 25, 2004

(30) Foreign Application Priority Data

Sep. 20, 2002 (EP) ..... 02021011

(51) Int. Cl.[7] ..... F23R 3/04
(52) U.S. Cl. ..... 60/776; 60/737; 431/354
(58) Field of Search ..... 60/39.11, 725, 60/737, 738, 772, 776; 431/354

(56) References Cited

U.S. PATENT DOCUMENTS 5,609,030 A * 3/1997 Althaus ..... 60/737
6,691,518 B2 * 2/2004 Doebbeling et al. ..... 60/737
6,832,481 B2 * 12/2004 Koenig et al. ..... 60/737

FOREIGN PATENT DOCUMENTS

EP 0 193 838 A2 9/1986
WO WO 98/11383 3/1998

* cited by examiner

*Primary Examiner*—Louis J. Casaregola

(57) ABSTRACT

The invention relates to a premix burner for burning fuel with air to combustion gas, in particular within a combustion turbine. Profiling means are provided for profiling the mass stream of the combustion air in a direction radial to an annular shaped air channel in order to generate a radial varying fuel/air mixture that stabilises the combustion. Accordingly, the invention also relates to a gas turbine and a process for burning fuel in air.

15 Claims, 3 Drawing Sheets

PREMIXED BURNER WITH PROFILED AIR MASS STREAM, GAS TURBINE AND PROCESS FOR BURNING FUEL IN AIR

CROSS REFERENCE TO RELATED APPLICATIONS

This application claims priority to the European application No. 02021011.8 EP, filed Sep. 20, 2002 under the European Patent Convention and which is incorporated by reference herein in its entirety.

FIELD OF THE INVENTION

The invention relates to a premix burner for burning a fuel in air and for stabilising a premixing flame, in particular a premix burner for a combustion turbine. The apparatus includes a premixing chamber in which fuel and air are premixed prior to burning the fuel.

BACKGROUND OF INVENTION

Under the designation "premix burner" a burner device is known to persons skilled and active in the relevant art, with the feature that the fuel is burned only with a certain time interval after its intermixing with the air provided for the combustion.

During the operation of a conventional premix burner, when the feeding of fuel to the burner is increased, a state is often reached in which the combustion becomes unstable and acoustic vibrations are caused in the plant into which it is fitted. The acoustic vibrations are known by the term "combustion vibrations". The combustion vibrations may be so large that they jeopardise the operation of the premix burner and the plant, of which the premix burner is an integral part. The tendency of a premix burner to form unstable combustion becomes all the greater, the more homogenous the mixture of fuel is and the air formed in the premix burner before the combustion. However, a mixture which is as homogeneous as possible is desired in view of the fact that the production of nitrous oxides during the combustion is lower, the more homogenous is the mixture. If the mixture is completely homogenous, the maximum temperature occurring during the combustion of the mixture assumes a minimum, and it is precisely this effect which is essential for an especially low production of nitrous oxides. European Patents EP 0 193 838 B1 and EP 0 589 520 B1 disclose such a device.

To stabilise the combustion of a premix burner, it has been proposed in U.S. Pat. Nos. 5,758,587 and 6,056,538 to Büchner et al to envelope the igniting mixture flowing from the burner with a veil of air and thus prevent vortices from forming in marginal regions of the mixture, in which vortices combustion processes take place, from which it may be assumed that they contribute substantially to the destabilisation of the combustion. This is achieved with the disadvantage of extracting air which is used to envelope the mixture from the actual combustion operation which markedly may increase the formation of nitrous oxides.

U.S. Pat. No. 6,152,724 which corresponds to European Patent 0 925 470 B1 describes a device for burning a fuel in air. This device includes a body having an axis and an annular passage formed therein for directing air in a meridional flow with regard to the axis; a swirl cascade connected to the body and imposing a swirl on the flow; an air flow delayer connected to the body and delaying a portion of the flow lying radially on an outside with regard to the axis relative to other portions of the flow; and a mixer connected to the body and intermixing fuel with the flow for forming a substantially homogeneous air/fuel mixture. The velocity in the flow, when the latter discharges from the device, is configured non-uniformly in the radial direction with regard to the axis. This is effected by the flow being locally disturbed in the annular passage by an appropriate obstacle in the form of a screen or the like, which is disposed at an appropriate point in the annular passage. But at the same time the homogeneity of the mixture of air and fuel in the flow is retained.

German Patent DE 198 39 085 C2 relates to a burner device for a firing installation, in particular a combustion turbine, with a main burner, which is a premixing burner, and a primary and secondary pilot burner. The primary pilot burner is surrounded by the main burner and centred with respect to the main axis of the main burner. The secondary pilot burner is placed at the outlet of the main burner, where the mixture of fuel and air enters the combustion chamber. The secondary pilot burner provides additional fuel through a number of orifices at the outlet of the main burner, which leads to a non-uniform contribution of fluid at the outlet of the main burner. To achieve this the installation of additional pipes for providing fluid a well as further mechanical features are necessary which makes the burner device more complicated and spacious.

International Patent Application WO 98/35186 A1 relates to an active method to suppress combustion vibrations in a combustion turbine plant. This method for active attenuation of a combustion oscillation in a combustion chamber uses at least two control elements, wherein an operating lever of the control elements requires the combustion oscillation to be measured only at a limited number of points. This is achieved mainly by using the symmetry of an acoustic vibration generated by self-excitation in the combustion chamber. All active methods to suppress and control combustion vibrations require additional electrical control equipment as well as sensors being exposed to the hot combustion gas.

SUMMARY OF THE INVENTION

It is accordingly an object of the invention to provide a premix burner for burning fuel in air that overcomes the above-mentioned disadvantages of the prior art devices and methods of this general type, in which a measure for stabilising the combustion process, in particular in a premix burner, is specified. Another object of the invention is to provide a gas turbine with a high stability of the combustion process over a broad range of operation. A further object of the invention is to provide a process for burning fuel in air wherein the combustion process remains stable over a broad range of operating conditions.

With the foregoing and other objects in view there is provided, in accordance with the invention, a premix burner comprising an annular air channel for guidance of combustion air along a flow direction and a fuel inlet at an fuel inlet position for feeding fuel into said combustion air, wherein a profiling means is located in said air channel upstream of said fuel inlet position for profiling the mass stream of said combustion air in a direction perpendicular to said flow direction, wherein according to said profiling, a fuel density downstream said fuel inlet varies along every radial direction through said annular air channel.

According to the invention, a fuel/air mixture is generated that has a non-homogenous distribution of fuel in air. This distribution varies along a radial direction through the annular air channel. This leads to a stabilisation of the flame within all ranges of operation and not only in the preferred range for normal operation of the burner, in which normal range other systems relying on resonators would work. A stabilisation of the premixing flame is achieved by an area of fuel enriched air, homogeneously distributed in a circumferential direction around the annular channel but, as stated above, non-homogenous in a radial direction. This goes with a locally higher fuel/air ratio (FAR). The fuel/air ratio is defined as the actual fuel/air mass ratio divided by the stochiometric fuel/air mass ratio. The air number lambda λ (which is used in Europe) is defined as the inverse of the fuel/air ratio. So the blocking member leads to a locally enriched mixture of fuel in air with a fuel/air ratio still under one (which means a lambda λ number still greater than one) compared to average fuel/air mixture in the premixing chamber. This locally enriched mixture burns in the combustion chamber with a higher burning temperature and therefore leads in the combustion chamber to locally and discrete increased burning temperature which on the other side stabilises the premixing flame and which shifts the lower limit for extinguishing of the flame to a lower fuel/air ratio (which means to higher air number).

Preferably, the profiling means is a perforated, annular shaped metal plate, wherein every hole of said plate has a respective hole area, thereby forming a hole area density of said metal plate and wherein said hole area density varies in a radial direction. Even more preferred, the hole area density increases in an outward radial direction. Such a perforated metal plate provides an easy to manufacture means for profiling the air mass stream. The plate might be of conical shape, i.e. a non flat surface but rather a part of a cone surface or the like. Of course, there are different possibilities of designing the profiling means like a grid or a sieve with varying mesh size.

In a preferred embodiment, the profiling is such that said mass stream of said combustion air increases in an outward radial direction. An increase of the air mass stream outwardly from the center of the burner to the outer edge of the air channel means an fuel enriched area in the center of the burner what test promised to be of particular effect with regard to flame stabilization. Preferably, the Burner the annular air channel encircles a central diffusion burner. In a diffusion burner, the area of mixing fuel and air is more or less identical to the area of combustion, i.e. no premixing of fuel and air is performed. Accordingly, the premix burner is also capable of a diffusion burning.

Advantageously, the burner further comprises at least one air blocking member situated at the air inlet for stabilising a burner premixing flame by locally blocking the flow of air entering said premixing chamber so that downstream said outlet a locally inhomogeneous fuel concentration results generating a locally hot stream of combustion gas being hotter than the average flame temperature. However, this blocking member causes an inhomogeneous distribution along a circumferential direction.

In accordance with a concomitant feature the blocking member is bound to the profiling means. The blocking member may be bound to the perforated plate by welding or any other appropriate method either downstream or upstream the plate. It may also be manufactured together with the plate and so being part of the plate.

According to the invention, there is also provided a gas turbine, comprising a burner according to the above described design. The burner is part of the gas turbine which includes a combustion chamber. The burner is in flow connection with the combustion chamber so that a mixture of air and fuel flows into the combustion chamber and fuel is burnt in the combustion chamber. A gas turbine further comprises components like a compressor and rotating blades and guide vanes, which are known to those skilled in the art and therefore not described in more detail.

Furthermore, according to the invention, there is provided a process for burning fuel in air, comprising the steps of guiding air through an annular channel of a premix burner;

profiling the mass stream of said air in such a way that the mass stream varies along every radial direction through said annular air channel;

feeding fuel into said profiled air stream at a fuel inlet position, thereby generating a fuel/air mixture with varying fuel density along every radial direction through said annular air channel;

igniting and burning said fuel/air mixture.

Preferably the fuel used is a fluid, in particular a gas, like for example natural gas, or a liquid, like oil. The fuel inlet and all other fuel guiding parts of the burner are preferably designed for the use of a fluidical—gaseous or liquid—fuel.

To achieve the stabilisation effect in a burner having a premixing chamber no essential change of the method for injecting fuel is necessary, as only the flow of air is influenced to generate an enriched fuel/air mixture.

In a burner design which tends at certain operating conditions to develop combustion induced vibrations the use of an appropriate profiling means according to the invention would furthermore largely suppress the formation of combustion induced vibrations and also reduces the maximum pressure amplitude of those combustion induced vibrations which eventually still develop. The maximum amplitude may be reduced by a factor of four or more. In addition, the use of an appropriate profiling means either in a burner design tending to develop combustion induced vibrations or a design free of those vibrations dramatically reduces the amount of carbon monoxide (CO) produced during the combustion process, in particular at higher air numbers.

The premix burner may be used in particular for a gas or combustion turbine, a heating installation, a furnace or other firing installations which use a burner having a premixing chamber.

In accordance with a further feature, the burner comprises a swirl element disposed in the annular channel for imposing a momentum or swirl to the flow of air. The swirl element further may serve for feeding the fuel in the flow of air. The swirl element may be configured as a swirl cascade which may be an axial, radial or diagonal swirl cascade in accordance with the requirement of the respective individual case. Preferably, the fuel is injected in the flow of air by a number of apertures in the swirl element to maintain an almost homogeneous mixture beside those inhomogenities caused by the profiling means. It is understood that in principle the fuel may be fed in any manner, for example via nozzles in the guide vanes of the swirl cascade or via separate mixing devices in front or behind the swirl cascade.

In accordance with a concomitant feature, the annular channel is inclined to the main axis of the premix burner, which means that an axis perpendicular to the cross-sectional area encircles an angle of less than 90° with the main axis of the burner. In fact, a number of perpendicular axis on the cross-sectional area (normal axis) form a surface of a cone with an opening angle less than 90° and with the main axis of the burner as centre axis.

In accordance with again an additional feature the burner is designed for operation with a fluidical fuel, in particular a gaseous fuel, like natural gas, or a liquid fuel, like oil. Those fuels are widely used in particular for stationary gas turbines for generating electrical power. Other fuels which may be used for jet engines could also be used. With those fuels a low concentration of $NO_x$ in the exhaust gas is reached to fulfil the more stringent environmental protection regulations.

Although the invention is illustrated and described herein as embodied in a premix burner, gas turbine and process for burning a fuel in air, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

DESCRIPTION OF THE PREFERRED EMBODIMENTS

Figure 1:
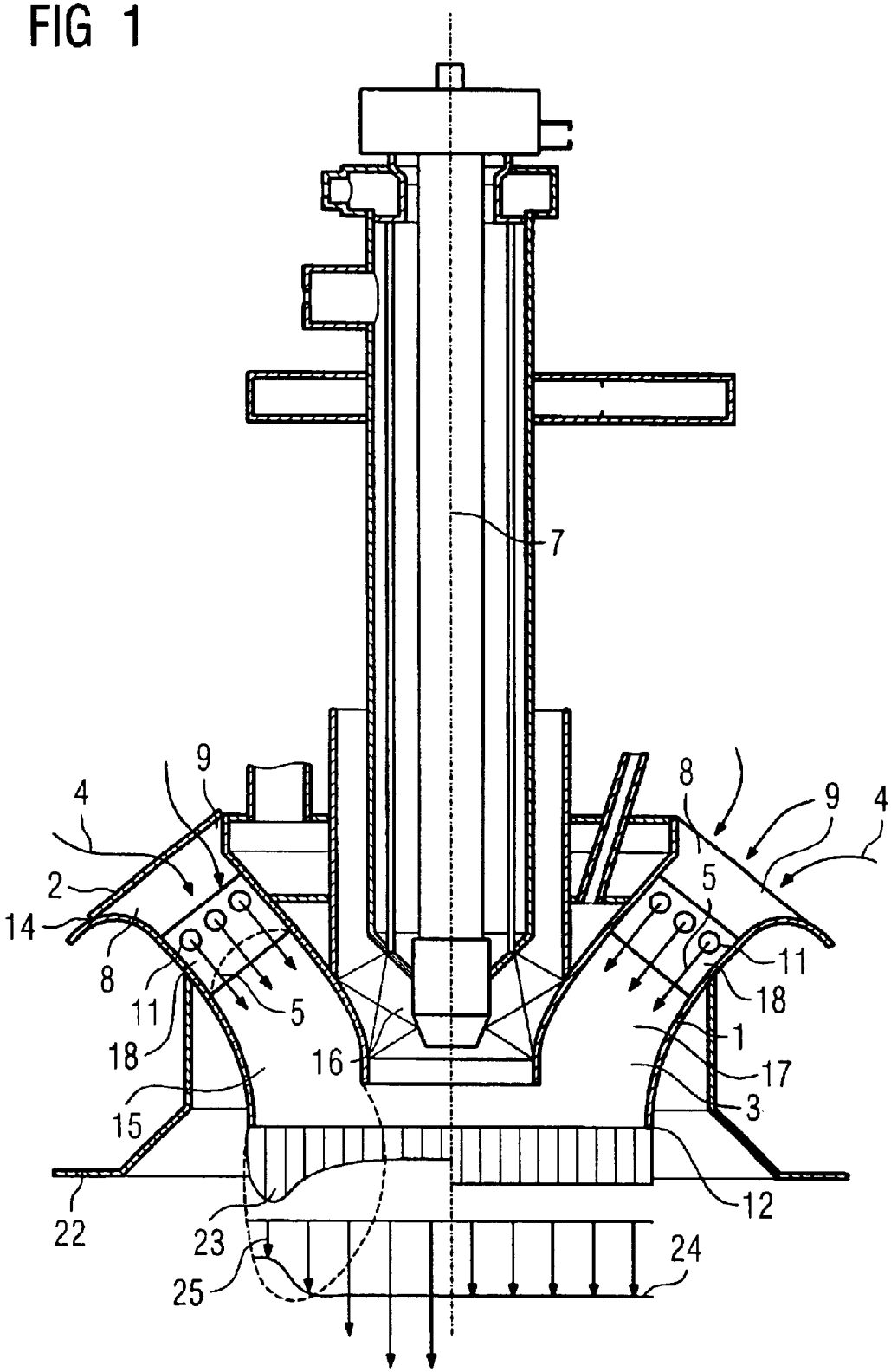
FIG. 1 is a longitudinal sectional view through an premix burner according to the invention.

In the figures of the drawing, components corresponding to one another of the respectively shown exemplary embodiments in each case have the same reference numeral.

The drawing is not to be considered as a representation of exemplary embodiments actually realised and is simplified in order to emphasise certain features. The information which can be gathered directly from the drawing can be supplemented for the practical construction within the limits of the knowledge and capability at the disposal of the persons skilled and active in the relevant art with due regard to the explanations preceding this information.

Referring now to the figures of the drawing in detail and first, particularly, to FIG. 1 thereof, there is shown an exemplary embodiment of the premix burner 1 according to the invention in a cross-sectional view along a main axis 7 of the apparatus 1.

The premix burner 1 extends along the main axis 7 and comprises a annular air channel 3. The annular air channel 3 has an annulus air inlet 8. In the air inlet 8 a annulus cross-sectional area 9 is inclined to the main axis 7 by an angle less than 90°. The annular air channel 3 has a circular outlet 12 centred to the main axis 7. Between air inlet 8 and outlet 12 a swirl cascade with a number of swirl elements 18. Each swirl element 18 extends across a annular channel 3. For sake of clarity only two swirl elements 18 are shown each of which has a number of fuel inlets 11, in particular formed as nozzles, for feeding fuel 5 to the annular air channel 3. The annular air channel 3 surrounds a diffusion burner 16 extending along the main axis 7 and centred to the main axis 7. The constructural features of the diffusion burner 16 are known to the person skilled in the art and are therefore not described in detail. The diffusion burner 16 has among other features an air inlet general with swirl or mixing elements, a fuel pipe and an outlet within the annular air channel 3.

The premix burner 1 is fitted in a wall 22 of a combustion chamber 20. The combustion chamber 20 could be an annulus chamber or a can like chamber and maybe part of a stationary gas turbine for generating electric power, a jet engine, a heating installation, a furnace or any other firing installation.

In the area of the air inlet 8 an air profiling means 2 is provided. The profiling means 2 is located at the outer periphery 14 of the air inlet 8.

During operation of the premix burner 1 a flow of air 4 is fed to the air inlet 8. This flow of air 4 flows through the annular channel 3 and is mixed with fuel 5 provided through the fuel inlet 11 of the swirl elements 18. While flowing through the annular air channel 3 air 4 and fuel 5 are mixed to form a almost homogeneous air/fuel mixture. This results in a concentration of fuel in this mixture at the outlet 12 which is nearly constant over the area of the outlet 12, where no profiling means 2 effects the flow of air 4 (right portion of the outlet 12 as shown in FIG. 1). Due to the air profiling means 2, the air mass stream increases in a radial outward direction. For comparison, the right side of the premix burner 1 is shown to be designed according to prior art without a profiling means 2, leading to a homogenous radial air mass stream distribution and therefore a homogenous radial fuel/air mixture. However, the left side of FIG. 1 shows the influence of the profiling means as to increase the mass flow rate 23 in an outward radial direction, thereby leading to a decrease of fuel density in the same direction as indicated by the arrows 25. In areas 23 with enriched fuel concentration, the profile 24 of the flow of the air/fuel mixture is influenced and shows a reduced velocity component 25. Due to the enriched mixture of fuel in area 23 a higher burning temperature is obtained in radial inward areas 23.

Downstream of the swirl element 18 expanding to the outlet 12 a premixing zone 15 is formed.

Figure 2:
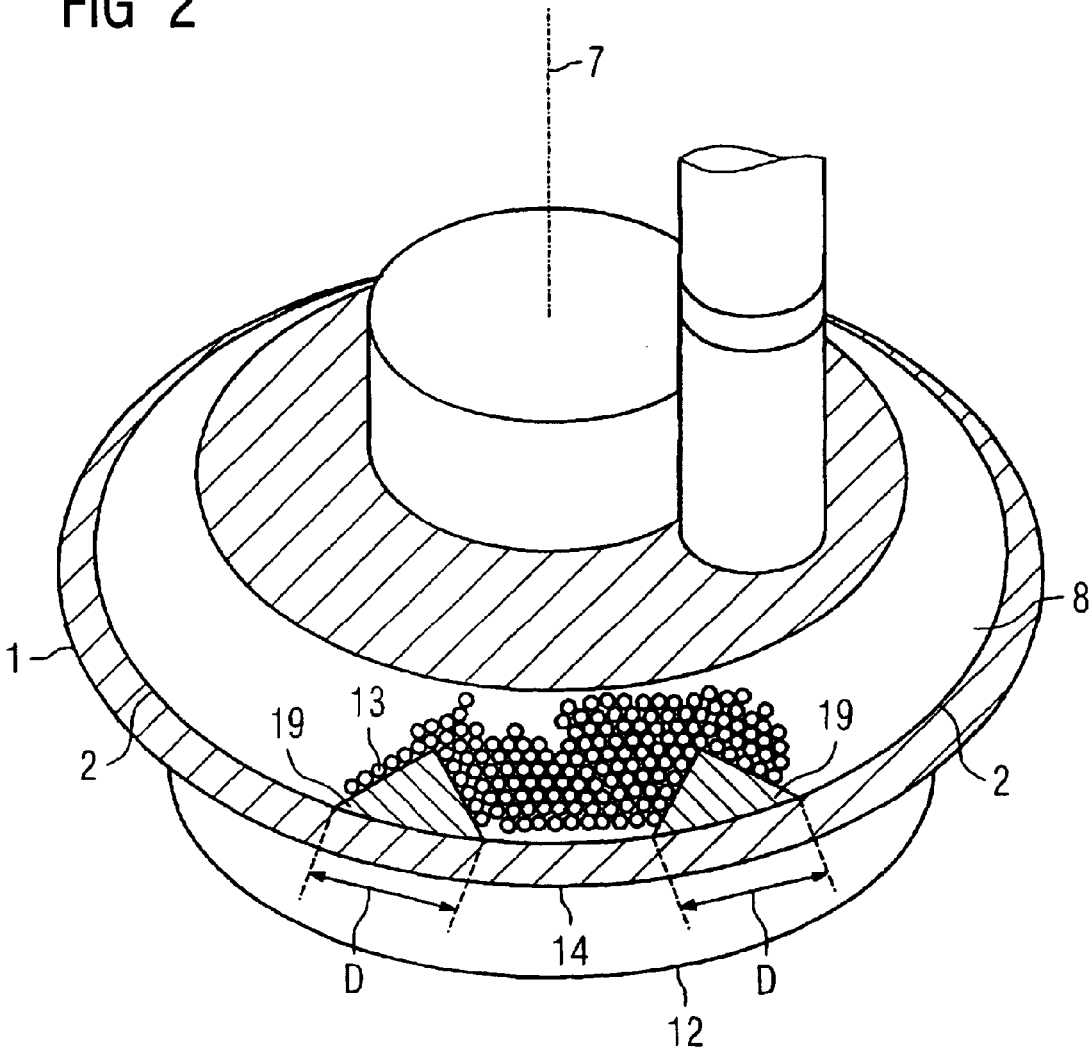
FIG. 2 is a perspective view of a premix burner.

FIG. 2 shows a perspective view of a premix burner 1 prior to insertion to the combustion chamber 20. In the air inlet 8 a perforated annulus plate forming the profiling means 2 is placed. This plate 2 has apertures 13 which allow the air 4 to enter the annular air channel 3. Further details are described with FIG. 3. Two blocking members 19 are welded to the plate 2, having a triangular shape. The base side of the triangular block member 19 has the width D. The blocking members 19 are placed on the perforated plate 2 with the base side located at the outer periphery 14 of the air inlet 8. The blocking members 19 generate circumferentially inhomogeneous air/fuel mixtures by delaying the air stream. This leads to discrete hot gas streams that additionally stabilise the combustion.

Figure 3:
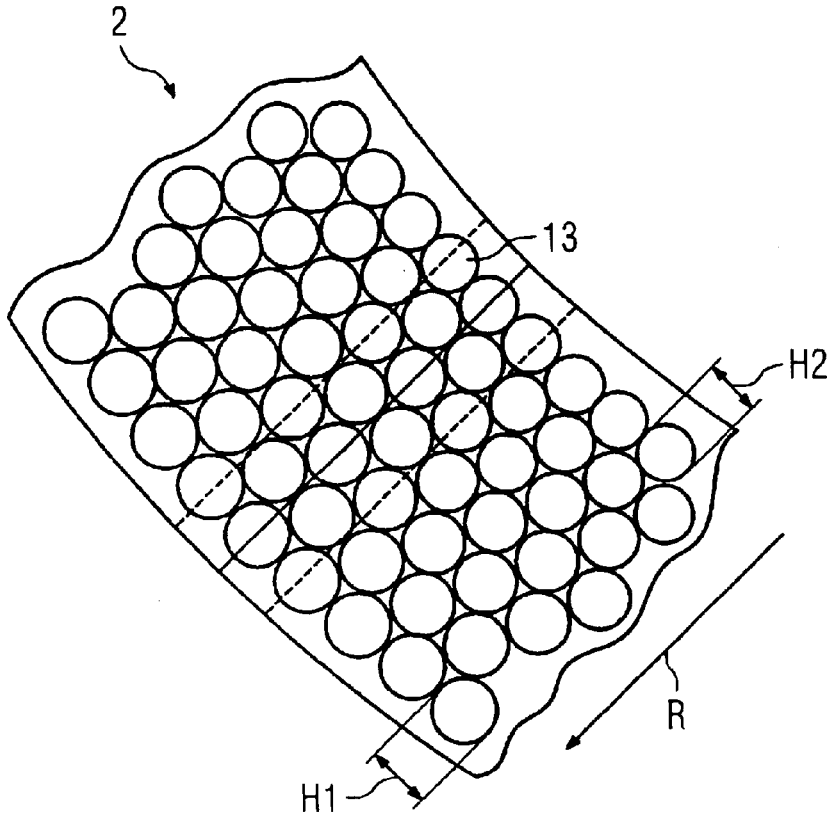
FIG. 3 is a part view of a profiling means.

FIG. 3 shows partly a profiling means designed as a perforated plate with apertures or holes 13 like in FIG. 2. In a radial outward direction R, the diameter H of each hole 13 increases approximately continuously from a minimum value H2 on the radial inward edge to a maximum value H1 at the radial outward edge. Accordingly, the hole area density over the surface of the plate 2 is not constant. In other words, the hole area density increases along the radial direction R. This leads to the described profiling of the air stream and accordingly the fuel/air mixture.

Figure 4:
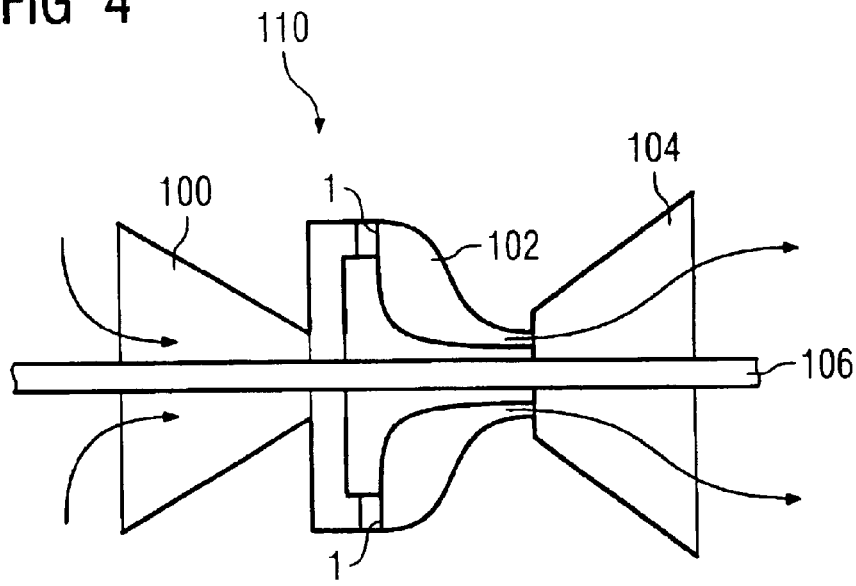
FIG. 4 is a schematic view of a gas turbine.

All the embodiments of the invention are of particular importance for use in a gas turbine in order to heat a compressed air flow there, provided by a compressor, by burning a fuel, whereupon the heated flow is expanded in a turbine. FIG. 4 shows schematically a gas turbine (110) with a compressor 100, an annular combustion chamber 102 and a turbine part 104, all mounted on a single shaft 106. Air 4 is compressed by the compressor 100 and introduced in the combustion chamber 102 by the premix burners 1, together with fuel as described above. Subsequently, the produced hot gases are guided through the turbine part 104, thereby rotating the shaft 106. In particular annular combustion chambers are subject to combustion instabilities and the invention is of particular value for those designs.

The invention is distinguished in particular by the fact that, on the one hand, it provides merely passive measures for the stabilisation of combustion and, on the other hand, it requires no branching of air from the air which is otherwise available for the combustion.

What is claimed is:

1. A premix burner comprising:

an annular air channel for guidance of combustion air along a flow direction; and a fuel inlet for feeding fuel into said combustion air, wherein a profiling means is located in said air channel upstream of said fuel inlet for profiling the mass stream of said combustion air in a direction perpendicular to said flow direction, wherein according to said profiling, a fuel density downstream said fuel inlet varies along every radial direction through said annular air channel.

2. A burner according to claim 1, wherein the profiling means is a perforated, annular shaped metal plate, wherein every hole of said plate has a respective hole area, thereby forming a hole area density of said metal plate and wherein said hole area density varies in a radial direction.

3. A burner according to claim 2, wherein the hole area density increases in an outward radial direction.

4. A burner according to claim 1, wherein the profiling means is a grid.

5. A burner according to claim 1, wherein the profiling means is a sieve.

6. A burner according to claim 1, wherein the profiling is such that said mass stream of said combustion air increases in an outward radial direction.

7. A burner according to claim 1, wherein the annular air channel encircles a central diffusion burner.

8. A gas turbine, with a premix burner, wherein the premix burner comprising:

an annular air channel for guidance of combustion air along a flow direction; and a fuel inlet for feeding fuel into said combustion air, wherein a profiling means is located in said air channel upstream of said fuel inlet for profiling the mass stream of said combustion air in a direction perpendicular to said flow direction, wherein according to said profiling, a fuel density downstream said fuel inlet varies along every radial direction through said annular air channel.

9. A process for burning fuel in air comprising:

guiding air through an annular channel of a premix burner;

profiling the mass stream of said air in such a way that the mass stream varies along every radial direction through said annular air channel;

feeding fuel into said profiled air stream at a fuel inlet, thereby generating a fuel/air mixture with varying fuel density along every radial direction through said annular air channel; and igniting and burning said fuel/air mixture.

10. A gas turbine according to claim 8, wherein the profiling means of the burner is a perforated, annular shaped metal plate, wherein every hole of said plate has a respective hole area, thereby forming a hole area density of said metal plate and wherein said hole area density varies in a radial direction.

11. A gas turbine according to claim 10, wherein the hole area density increases in an outward radial direction.

12. A gas turbine according to claim 8, wherein the profiling means is a grid.

13. A gas turbine according to claim 8, wherein the profiling means is a sieve.

14. A gas turbine according to claim 8, wherein the profiling is such that said mass stream of said combustion air increases in an outward radial direction.

15. A gas turbine according to claim 8, wherein the annular air channel encircles a central diffusion burner.

* * * * *